United States Patent [19]

Seecamp

[11] 4,428,138

[45] Jan. 31, 1984

[54] DOUBLE-ACTION TRIGGER MECHANISM WITH TRIGGER-BLOCKING MAGAZINE SAFETY FOR FIREARMS

[76] Inventor: Louis W. Seecamp, 487 Wolcott La., Orange, Conn. 06477

[21] Appl. No.: 369,604

[22] Filed: Apr. 19, 1982

[51] Int. Cl.[3] ..... F41C 17/02

[52] U.S. Cl. ..... 42/70 A

[58] Field of Search ..... 42/70 A, 7

[56] References Cited

U.S. PATENT DOCUMENTS

| | | | |
|---|---|---|---|
| 885,436 | 4/1908 | Clément | 89/146 |
| 2,138,213 | 11/1938 | Seidel | 89/147 |
| 2,296,998 | 9/1942 | Koehler | 42/3 |
| 2,464,427 | 3/1949 | Wilson | 264/427 |
| 3,722,358 | 3/1973 | Seecamp | 89/147 |

FOREIGN PATENT DOCUMENTS

| | | | |
|---|---|---|---|
| 107894 | 11/1927 | Austria | 42/70 A |

OTHER PUBLICATIONS

Parts Lists for "Astra" Camper, Cub, and Firecat Automatic Pistols.

*Primary Examiner*—Charles T. Jordan
*Assistant Examiner*—Ted L. Parr

[57] ABSTRACT

A double-action trigger mechanism for firearms having a pivoted trigger and hammer with a draw-bar connecting them for cocking the hammer by means of the trigger, together with a trigger-blocking magazine safety for preventing firing of the gun when the cartridge magazine is removed. A multiple purpose spring is provided which acts as a trigger-return spring, a magazine-safety spring and a draw-bar spring. In addition, provision is made for limiting the retraction of the breech-bolt or slide when the magazine is removed so that a live cartridge in the chamber can not be extracted or a fresh cartridge can not be inserted into an empty chamber until the magazine is replaced.

7 Claims, 7 Drawing Figures

DOUBLE-ACTION TRIGGER MECHANISM WITH TRIGGER-BLOCKING MAGAZINE SAFETY FOR FIREARMS

BACKGROUND OF THE INVENTION

The invention relates to firearms, and it relates more particularly to a trigger-blocking magazine-safety system for auto-loading pistols having a trigger-cocking mechanism in which a pivoted hammer is cocked when the trigger is pulled. In accordance with one aspect of the invention a utility spring is provided which combines the functions of three separate springs: one for returning the trigger when it is released following a triggering cycle; one for resiliently maintaining the cocking link or draw-bar in engagement with the hammer; and one for actuating a safety member in order to positively prevent firing the pistol when the cartridge magazine is not in the pistol.

A so-called magazine safety is a device which is actuated upon removal of the cartridge magazine to block or disconnect the trigger mechanism so that the gun can be fired only when the magazine is in place. The purpose of rendering the gun incapable of firing without the cartridge magazine is to prevent those accidental shootings which occur because people not versed in gun safety or operation may believe the gun is completely unloaded when the magazine is withdrawn, whereas actually a round is still in the chamber. Additionally, a magazine safety allows the gun owner to keep his gun ready for self-defense yet safe from unauthorized use during brief periods when it may be left unattended. There are also people, particularly among the elderly and handicapped, who find it difficult to retract the slide of a semi-automatic pistol in order to ready the weapon for firing. A magazine safety permits such people to safely keep a round in the chamber at all times by removing the magazine so that the gun can not be fired by children or others who may gain unauthorized access to it. The gun can nevertheless be quickly brought to a state of readiness by simply inserting the cartridge magazine, which can be kept in a safe place on one's person or elsewhere.

A magazine safety which blocks the trigger, as distinguished from disconnecting it, is shown in U.S. Pat. No. 2,296,998 to E. F. Koehler. In this case the blocking member is actuated by a spring which is depressed when the blocking member is moved out of its blocking position as the magazine is inserted into the pistol. Unlike the present invention, however, the only function of this spring is to actuate the blocking member.

Magazine safeties, which block the trigger, are also employed in the Astra "Camper", "Cub" and "Firecat" pistols manufactured in Spain by Unceta and Co. S.A., but in these cases only a single-action firing mechanism is employed, and the spring has just one function, whereas the spring of the present invention performs a multiple of functions.

Trigger-cocking mechanisms, so-called because the hammer is cocked by the trigger, are used in what are commonly known as "double-action" pistols, which have a pivoted hammer that is engaged by a draw-bar connected to the trigger so that the hammer is first cocked as the trigger is pulled and then released to fire a cartridge in the chamber. Single-action pistols, on the other hand, are those in which the trigger performs the single function of releasing the hammer, which must first be cocked directly by hand. Some guns are designed to be fired only in double-action, some only in single-action, and others in either mode. The present invention is applicable to guns designed to be fired in double-action, whether by itself or in addition to single-action. Pistols capable of being fired in single-action as well as in double-action are shown in U.S. Pat. No. 2,464,427 to G. A. Wilson and in my prior U.S. Pat. No. 3,722,358.

In U.S. Pat. No. 885,436 to C. P. Clement, a single spring is employed which functions both as a trigger-return spring and as a positioning spring by urging a link between the trigger and sear upward and forward. In this case, however, the trigger mechanism is not double-action, and the spring employed could not be used with a trigger-cocking draw-bar due to the amount of movement required in such an action. A spring similar to that shown in the Clement patent, but adapted for double-action, is employed in the Browning BDA .45 caliber semi-automatic pistol manufactured in West Germany. However, neither the Clement nor the Browning BDA springs function to activate a magazine safety.

U.S. Pat. No. 2,138,213 to A. Seidel shows a spring which acts both as a trigger spring and as a positioning spring for a connecting rod between the trigger and sear. However, the trigger mechanism is single-action, and the spring does not activate the magazine safety.

Accordingly, while trigger-blocking magazine springs, as well as multiple-function link or draw-bar springs have been employed before, none to my knowledge discloses a single trigger-mechanism spring which operates the entire linkage from returning the trigger to cocking the hammer, as well as to activate a magazine safety. The object of the present invention is therefore to provide a double-action trigger mechanism having a single spring which serves as the trigger-return spring, the magazine-safety spring and the draw-bar spring. A further and important object of the invention is to provide a magazine safety system in which the slide or breech-bolt of the gun is partially blocked when the cartridge magazine is removed preventing insertion of a cartridge into the chamber until the magazine is replaced, thereby permitting the slide to be retracted only far enough to determine whether or not the chamber is empty, but not far enough to allow a cartridge to be extracted if one is in the chamber, or to be chambered if the chamber is empty.

SUMMARY OF THE INVENTION

In accordance with one aspect of the invention, a single spring is pivotally mounted on the pivot pin for a trigger-blocking magazine-safety member with one end of the spring engaging the blocking member so that it is resiliently urged toward its blocking position. The other end of the spring is fixed to the draw-bar of the trigger mechanism in such a way that it urges the draw-bar both into operative relationship with the hammer and in a direction generally opposite to that in which it is drawn by the trigger, so that the trigger is returned when it is released.

Desirably the spring is pivoted adjacent one of its ends at a fixed point near the blocking member and is fixed to the draw-bar at its other end. One or more small coils may be provided which encircle a pivot pin at the pivoted end with an end portion extending into engagement with, and exerting a force against, the blocking member in order to urge it into its blocking position with respect to the trigger, the reaction to such force being in such a direction as to urge the draw-bar into operative relationship with the hammer. In addition a large coil may also be provided midway between the ends of the spring with two lengths of the spring extending therefrom which tend to spread apart in order to urge the draw-bar in the direction to return the trigger when pulled. The magnitude and direction of the force exerted by the spring on the draw-bar is thereby enhanced as it is drawn by the trigger over a relatively long span while the hammer is being cocked.

In accordance with another important aspect of the invention, the draw-bar may be formed such that when the trigger-blocking magazine-safety member blocks the trigger, the breech-bolt or slide is partially blocked by the hammer, preventing it from being retracted far enough to insert a cartridge into the chamber manually, while permitting it to be retracted far enough in order to check whether a cartridge is still in the chamber.

DETAILED DESCRIPTION OF PREFERRED EMBODIMENT OF THE INVENTION

One embodiment of the invention as it applies in a straight double-action, trigger mechanism, which does not include a single-action function in that it is not provided with a cocking sear, is illustrated in the accompanying drawings, in which FIG. 1 is a side elevational view, partially broken away and in section, of a semi-automatic pistol incorporating the invention;

Figure 1:
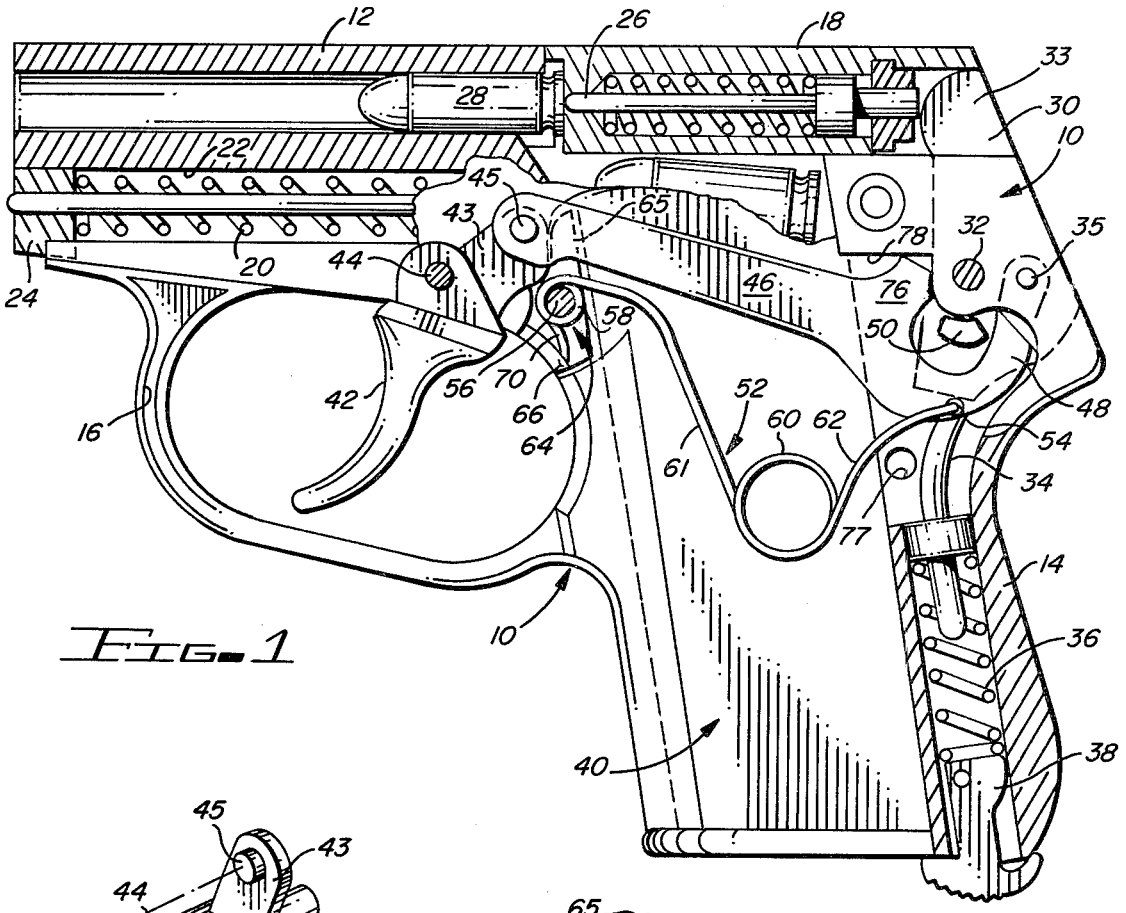
Figure 2:
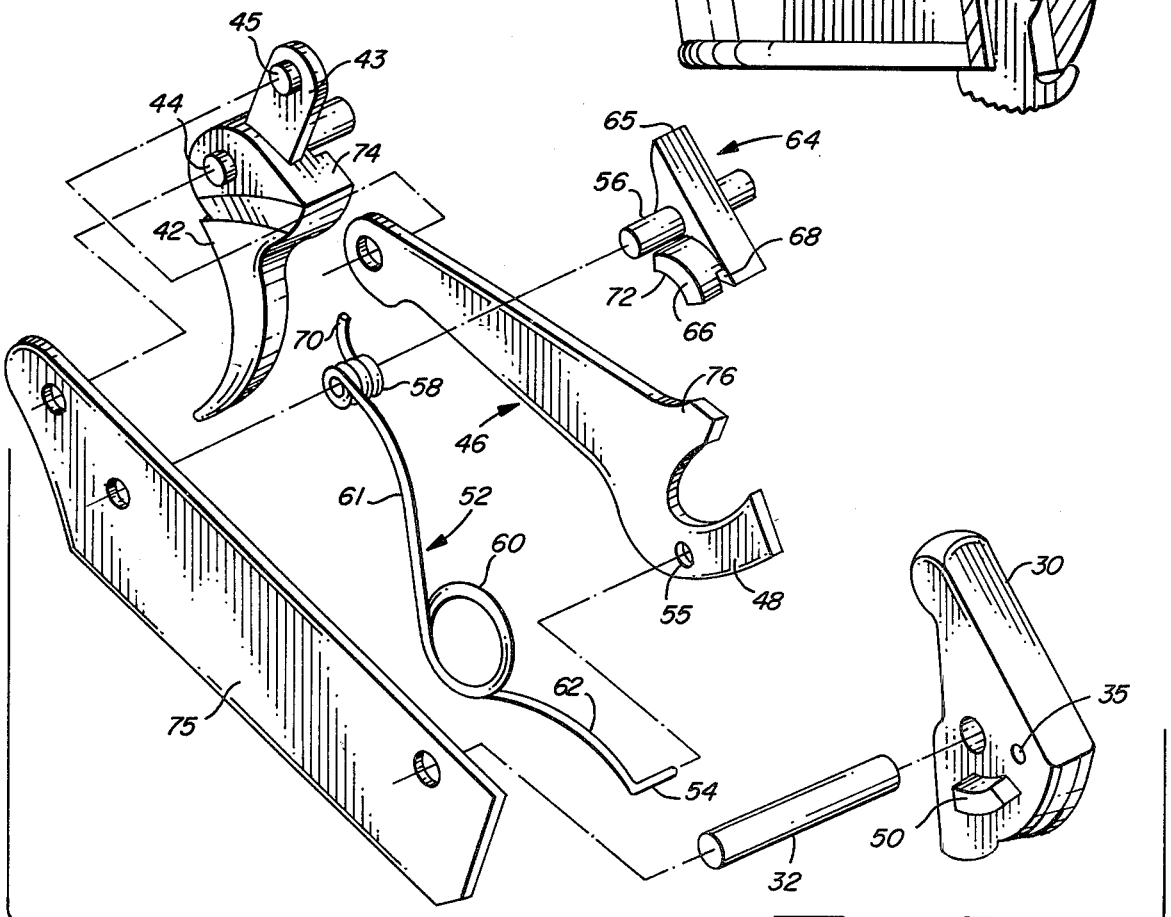
FIG. 2 is an exploded view of the trigger mechanism and trigger-blocking magazine-safety system shown in FIG. 1.
Figure 3:
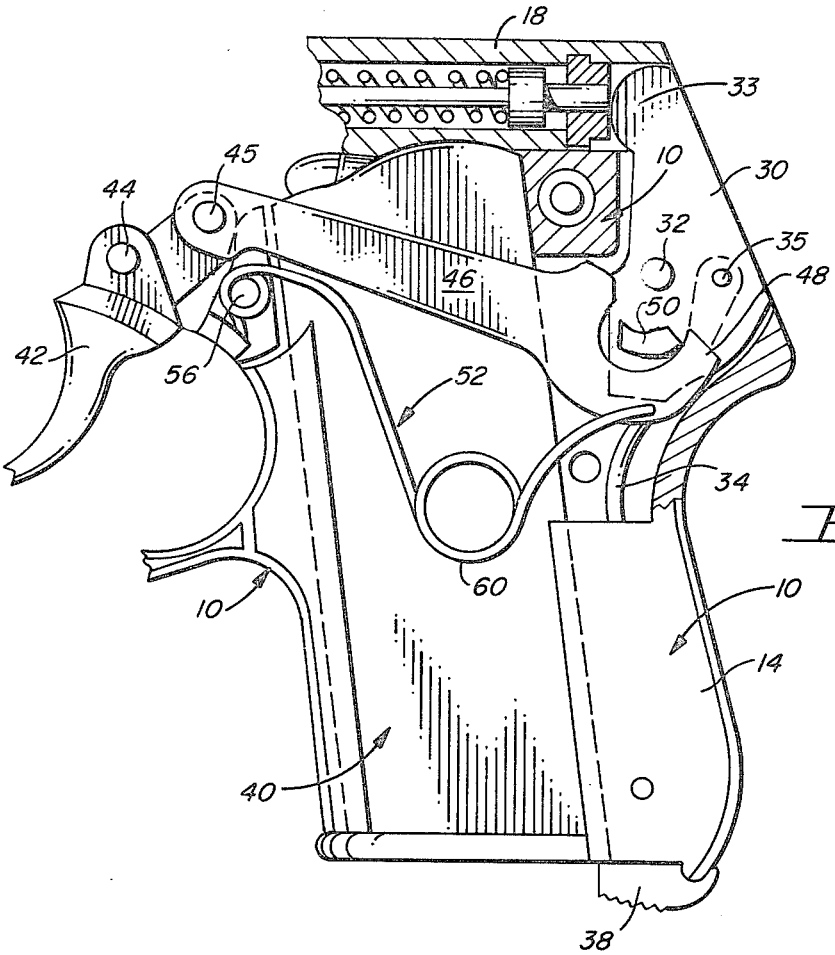
FIG. 3 is a view similar to FIG. 1, but with the barrel removed and portions cut-away and in section in order to expose the parts below, showing the trigger, draw-bar and hammer in the normal positions, prior to initiation of a triggering cycle.

Referring more particularly to FIGS. 1 to 3, the gun in which the invention is illustrated in a semi-automatic blow-back pistol having a frame 10, which in this instance includes, as integral parts thereof, the barrel 12, grip portion 14 and trigger guard 16. A slide 18 is mounted in conventional manner on the frame 10 for reciprocal movement from a chamber-closing or battery position as shown in FIG. 1 to a retracted position for extracting an empty case from the chamber and feeding a fresh cartridge into the chamber on return to its battery position. A recoil spring 20 in a spring tunnel 22 below barrel 12 urges slide 18 into battery by applying its pressure against an abutment 24 at the front of slide 18. A spring-loaded firing pin 26 of standard inertia design extends longitudinally through the slide for discharging a cartridge 28 in the cartridge chamber at the rear of the bore of barrel 12.

A hammer 30 is pivoted to frame 10 on a hammer pin 32 for engagement of its striker portion 33 with the rear end of the firing pin 26. Hammer 30 is driven through a stirrup 34, pivoted thereto at 35, by a mainspring 36 in a spring tunnel in the backstrap of grip 14. The lower end of mainspring 36 presses against a magazine catch 38, which is pivotally mounted so that it is urged clockwise into latching engagement with the footplate of a cartridge magazine 40 slidably retained thereby within the grip portion 14 of frame 10. Magazine 40 is of conventional design to hold a spring-loaded column of cartridges which are fed one by one into the cartridge chamber as the slide is driven rearward either by hand or on recoil when the gun is fired.

A trigger 42 is pivoted to the frame 10 on a pin 44 and has an upward extension 43, to which is pivoted at 45 one end of an elongated, hammer-cocking draw-bar 46. The rear end of draw-bar 46 is provided with a claw 48 which engages a cocking lug 50 on the lower end of the hammer 30 below the hammer pin 32. Accordingly, when draw-bar 46 is drawn forward (to the left as shown in the drawings) by pulling the trigger 42 counterclockwise, the hammer 30 is pivoted clockwise against the pressure of mainspring 36 until the claw 48 passes under the lug 50 releasing the hammer to strike the firing pin.

The claw-end of draw-bar 46 is urged upward and rearward (to the right as viewed in the drawings) by a multiple-purpose torsion spring 52 which has a foot 54 (FIG. 2) at one end extending laterally therefrom into a hole 55 in the claw-end of draw-bar 46. Torsion spring 52 extends from the hammer-engaging, claw-end of draw-bar 46 forwardly to, and is pivotally supported on, a pin 56 fixed in the frame 10, by means of a nest of small coils 58 at the forward end of spring 52 which encircle the pin 56. A large coil 60 is provided midway between the ends of spring 52 and, in its unstressed condition as shown in FIG. 2, has two arms 61 and 62 extending away from each other in substantially opposite directions. The arm 61 extends forward to the small coils 58, while the arm 62 extends rearward and is fixed to the claw-end of draw-bar 46 by means of the foot 54. In order to install the spring, the arms 61 and 62 must be flexed toward each other stressing the large coil 60, so that a rearward force is exerted on the draw-bar 46, which in turn urges the trigger 42 in a clockwise direction. Spring 52 therefore acts as a trigger-return spring.

Immediately rearward of trigger 42 and pivoted to frame 10 on the pin 56 is a trigger-blocking, magazine-safety member 64, best seen in FIG. 2. A finger 65 of member 64 extends above pin 56 for engagement by the upper front edge of magazine 40 when the magazine is in place. Below pin 56 and extending laterally from the blocking member 64, is an arcuately shaped blocking lug 66 which is provided with a notch 68 on its rear edge. A short end-section 70 extending from the innermost coil of the nest 58 on torsion spring 52 is inserted into notch 68, so that when spring 52 is stressed in order to align and affix the foot 54 in the hole 55 in draw-bar 46, the end 70 of the spring exerts a downward force on the blocking lug 66, thereby urging the pivoted blocking member 64 in a clockwise direction, while exerting an upward force on the claw-end of the pivoted draw-bar 46.

Figure 6:
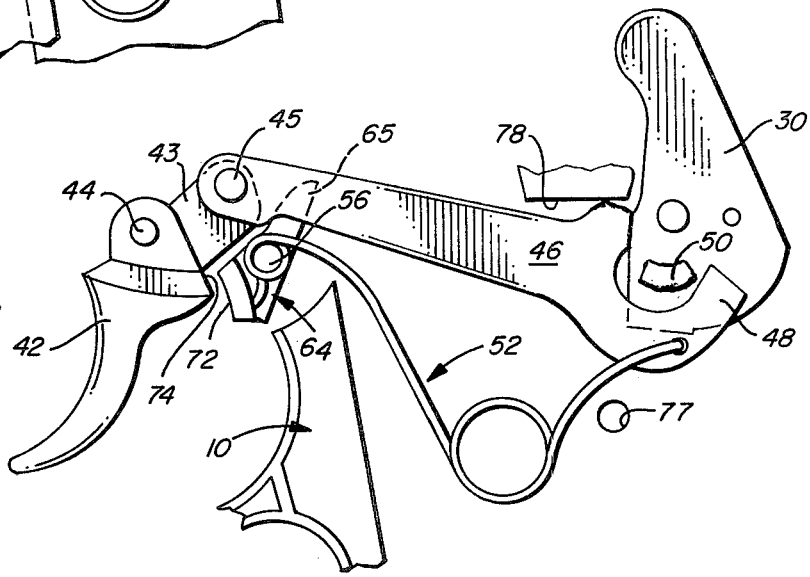
FIG. 6 is another view similar to FIG. 4, but with the trigger, cocking-bar and hammer in their normal positions as in FIG. 3, and with the magazine withdrawn, thereby activating the trigger-blocking safety.

As long as the magazine 40 is in place the blocking lug 66 is held by engagement of the magazine with the finger 65 of the member 64 in the position shown in FIG. 1 where it is clear of the trigger 42, so that the trigger can be pulled in a counterclockwise direction to cock the hammer (FIG. 4) and fire a chambered cartridge. However, when the magazine 40 is removed, the finger 65 is free to move rearward, permitting blocking member 64 to pivot clockwise under the pressure of the end 70 of torsion spring 52. Such movement brings the blocking lug 66 into its blocking position, as shown in FIG. 6, where the underside 72 of lug 66 is disposed in the path of a shelf 74 on the back edge of trigger 42, positively blocking the trigger from being pulled beyond a predetermined point, which is insufficient to fully cock and release the hammer.

It will be noted from FIG. 2 that when the spring 52 is unstressed the end section 70 is disposed nearly 180° from the arm 61. Consequently, when spring 52 is installed, the small coils 58 are stressed by flexing the arm 61 in a clockwise direction toward the end 70, forcing it against the blocking lug 66 and at the same time causing the rest of spring 52 to exert an upward reaction-force against the claw-end of draw-bar 46, in order to maintain it in operative position with the cocking lug 50 of the hammer.

As shown in FIG. 2, a side plate 75 is provided, having three holes which fit loosely over the trigger pin 44, the magazine safety pin 56 and the hammer pin 32. A side grip (not shown) is fastened over side plate 75 by means of a suitable screw through a hole 77 in frame 10.

Figure 4:
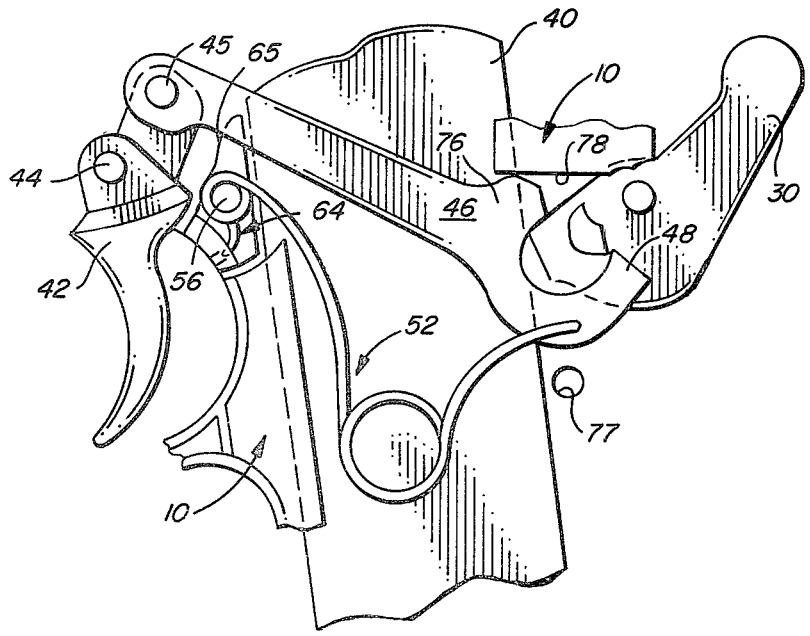
FIG. 4 is a more-or-less diagrammatic view of only the trigger mechanism, hammer and portions of the magazine and frame, showing the trigger in the process of being pulled so that the hammer is partially cocked.

Referring again to the hammer-cocking draw-bar 46, it will be noted that an upwardly extending positioning hump 76 is provided on the upper edge thereof forward of the claw 48, and forming therewith a U-shaped section that surrounds the cocking lug 50 on hammer 30. Hump 76 is urged upward by spring 52 against a guide surface 78 on the frame 10, so that as the hammer 30 is cocked during a triggering-cycle, claw 48 moves downward so that the cocking lug 50 on the hammer rides up the front edge of the claw as illustrated in FIG. 4 until it escapes the tip of the claw releasing the hammer, which is then free to fall under the force exerted on it by the mainspring 36.

Figure 5:
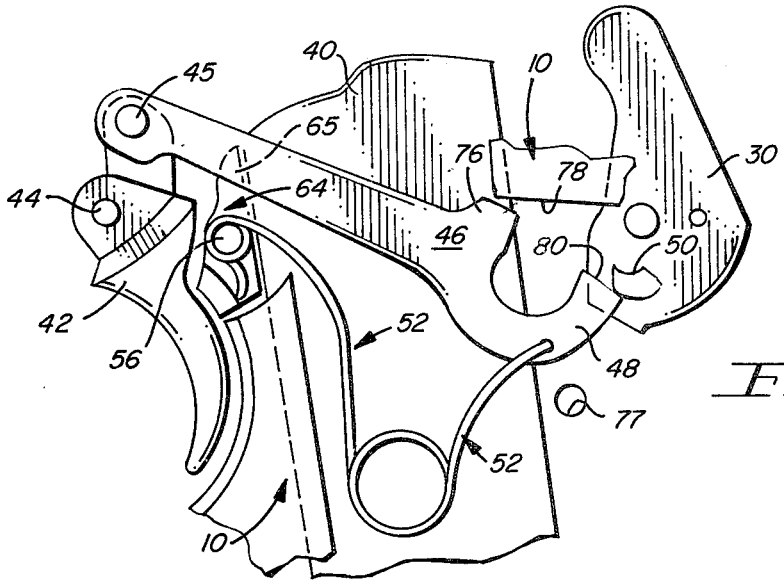
FIG. 5 is a view similar to FIG. 4, showing the trigger pulled, the hammer having been released and pivoted by the mainspring to the position at which it strikes the firing pin.

Since the trigger mechanism of the pistol here shown is a straight double-action (i.e. no sear), the hammer will then be located in the position shown in FIG. 5 regardless of whether or not a cartridge was fired. At this point in the triggering cycle, a straight surface 80 on the upper edge of claw 48 rests on the underside of cocking lug 50, so that when the trigger is released, spring 52 drives the draw-bar 46 rearward, with the surface 80 sliding along the bottom of lug 50 until claw 48 returns to the position shown in FIG. 1, the upward force exerted by the small coils 58 of spring 52 causing the claw 48 to move upward as soon as the tip of the claw passes rearward of the lug 50. The upward movement of claw 48 is then again limited by engagement of hump 76 with the guide surface 78 on the frame. It will be noted that the surface 80 is only slightly sloped relative to the direction in which draw-bar 46 moves lengthwise, in order to reduce the resistance to the rearward force exerted by spring 52. Furthermore, the force exerted by spring 52 rearwardly should be substantially greater than its upward force. This is readily obtained by properly coiling spring 52 and in selecting the point at which spring 52 engages bar 46 such that the desired amount and direction of the force exerted by the foot 54 on the draw-bar is attained.

As hereinbefore mentioned, when the magazine 40 is removed the trigger-blocking member 64 is free to pivot clockwise under the force of the end 70 of spring 52 until it engages the rear edge of the extension 43 of trigger 42, as shown in FIG. 6. If the trigger is pulled its shelf 74 engages the underside 72 of the blocking lug 66, thereby limiting the trigger to only slight movement in a counterclockwise direction as viewed in the drawings. Since the trigger can not be moved any appreciable amount, it can not cock the hammer to fire the gun. It should be noted, moreover, that when the trigger is pulled with the magazine safety 64 in its blocking position, the shelf 74 engages the underside 72 of blocking member 64 at a point which tends to pivot member 64 toward its blocking position, rather than out of it. Consequently, there is no way the blocking member can be moved out of its blocking position when the trigger is pulled. In other words a positive safety is provided against inadvertent or unauthorized firing of the weapon when the magazine 40 has been removed.

Figure 7:
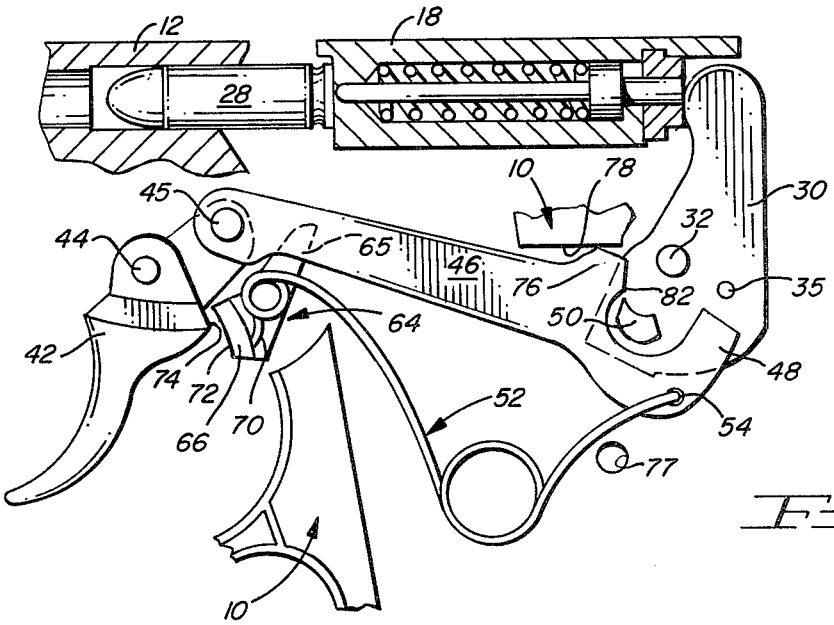
FIG. 7 is a view similar to FIG. 6, but also showing the slide and the chamber portion of the barrel, the slide being retracted as far as it can go with the magazine removed.

Referring now more particularly to FIG. 7, it will be noted that the trigger-blocking magazine-safety of the present invention not only positively prevents firing the pistol when the magazine has been removed, but also can be employed to prevent insertion of a fresh cartridge directly into the chamber instead of by means of the magazine. Thus, as before, when the cartridge magazine is removed, blocking member 64 is pivoted by the end 70 of spring 52 into its blocking position. If the slide 18 is then retracted manually pivoting the hammer 30 clockwise, the cocking lug 50 is moved within the space between the claw 48 and hump 76 of the draw-bar 46 until it engages a projection 82 on the rear edge of the hump 76 which lies in the path of lug 50, as illustrated in FIG. 7. Only a slight further retraction of slide 18 from the position shown can be made, as the cocking lug 50 moves upward and forward against the projection 82 pushing hump 76 on the draw-bar 46 upward against the guide surface 78 of the frame and at the same time moving bar 46 longitudinally to the left as viewed in the drawing, thereby pivoting trigger 42 counterclockwise until its shelf 74 comes into engagement with the underside 72 of lug 66 on the blocking member 64. Consequently, with the magazine removed, the slide can be retracted only far enough to determine whether or not a cartridge is in the chamber, but not far enough to permit a cartridge to be inserted into an empty chamber.

The amount of retraction of the slide permitted under these conditions can be predetermined by the size and shape of the projection 82, which can be readily changed by a simple filing operation. Moreover, if it is desired to eliminate this safety feature, the projection 82 can be removed completely so that the hammer 30 can be pivoted back as far as necessary by the slide 18 to permit full retraction of the slide.

I claim:

1. In a double-action trigger mechanism for semi-automatic firearms having a trigger and a hammer both pivotally mounted on a frame in spaced relation to each other, a trigger-blocking member pivoted to said frame for movement out of a blocking position when a cartridge-magazine is inserted into place, and a draw-bar pivotally connected to said trigger and extending into operative relation with said hammer for cocking said hammer when said trigger is pulled moving said draw-bar in one direction, a spring pivotally mounted on a pivot pin for said trigger-blocking member and having one end urging said trigger-blocking member toward its blocking position, the other end of said spring being fixed to said draw-bar and urging it in a direction both into operative relationship with said hammer and generally in a direction for returning said trigger when it is released.

2. A trigger device as defined in claim 1, wherein said spring is provided with a coil encircling said pivot pin and stressed such that the reaction to the force exerted by said one end against said blocking member is exerted in a direction against said draw-bar to pivot it into operative relationship with said hammer.

3. A trigger device as defined in claim 2, wherein said spring is also provided with a large coil intermediate its ends, a substantially straight section extending from said small coil to said large coil and a second substantially straight section extending from said large coil to said other end of said spring, said straight sections being stressed inwardly toward each other such that they exert a force outwardly of each other against said draw-bar in order to urge said draw-bar in said direction for returning said trigger.

4. A trigger device as defined in either claim 2 or 3, wherein a plurality of said coils encircle said pivot pin.

5. A double-action trigger mechanism having a pivoted trigger and a pivoted hammer in spaced relation therewith, a draw-bar pivoted at one end to said trigger with its other end disposed adjacent said hammer for cocking engagement therewith, a trigger-blocking, magazine-safety member pivoted on a pin adjacent said trigger and pivotable into and out of a blocking position relative to said trigger for positively preventing said trigger from cocking said hammer when the cartridge magazine is removed, and a torsion spring having a small coil encircling said blocking-member pivot pin with one end engaging said blocking member and urging it into its blocking position, the other end of said torsion spring being fixed to said draw-bar such that said draw-bar is urged into operative relationship with said hammer by the reaction force of said one end of said torsion spring against said blocking member, said torsion spring having a large coil disposed intermediate said pin-encircling coil and said other end with substantially straight sections extending therefrom in different directions stressed inwardly toward each other such that they exert a force outwardly of each other against the draw-bar in order to urge said draw-bar in the direction for returning said trigger.

6. A double-action trigger mechanism as defined in claim 5, wherein a plurality of said small coils encircle said blocking-member pivot pin.

7. A double-action trigger mechanism as defined in either claim 5 or 6, wherein said hammer is provided with a cocking lug by which said draw-bar cocks said hammer when said trigger is pulled, said draw-bar having a claw at its other end for engaging said cocking lug, said draw-bar having a projection disposed within the path of said cocking lug on said hammer, such that said cocking lug engages said projection when said hammer is pivoted toward a cocking position other than by means of said trigger and draw-bar, whereby such pivotal movement of said hammer toward its cocking position is positively limited by engagement of said cocking lug with said projection when said blocking-member is disposed in its blocking position on withdrawal of the cartridge magazine, preventing substantial movement of of said trigger and draw-bar.

* * * * *